US007759832B2

(12) United States Patent
Lin et al.

(10) Patent No.: US 7,759,832 B2
(45) Date of Patent: Jul. 20, 2010

(54) FAN

(75) Inventors: Ko-Chieh Lin, Taoyuan (TW); Lee-Long Chen, Taoyuan (TW); Wen-Tsao Lee, Taoyuan (TW); Kuo-Tung Hsu, Taoyuan (TW)

(73) Assignee: Delta Electronics, Inc., Taoyuan Sien (TW)

( * ) Notice: Subject to any disclaimer, the term of this patent is extended or adjusted under 35 U.S.C. 154(b) by 396 days.

(21) Appl. No.: 10/942,990

(22) Filed: Sep. 17, 2004

(65) Prior Publication Data

US 2005/0079057 A1 Apr. 14, 2005

(30) Foreign Application Priority Data

Oct. 8, 2003 (TW) ..... 92127917 A

(51) Int. Cl.
*H02K 5/16* (2006.01)

(52) U.S. Cl. ..... 310/90.5

(58) Field of Classification Search ..... 310/90, 310/90.5

See application file for complete search history.

(56) References Cited

U.S. PATENT DOCUMENTS 2,856,239 A * 10/1958 Dacus ..... 310/90.5
2,969,472 A * 1/1961 Faller ..... 310/82
3,934,950 A * 1/1976 Kuhlmann ..... 310/90.5
4,755,709 A * 7/1988 De Jager ..... 310/90.5
5,453,650 A * 9/1995 Hashimoto et al. ..... 310/268
5,610,462 A * 3/1997 Takahashi ..... 310/90
5,783,885 A * 7/1998 Post ..... 310/90.5
5,994,803 A * 11/1999 Jung ..... 310/51
6,227,820 B1 * 5/2001 Jarvik ..... 417/423.12
6,232,685 B1 * 5/2001 Swetish et al. ..... 310/71
6,417,590 B1 * 7/2002 Komura et al. ..... 310/90.5
6,787,956 B2 * 9/2004 Sun ..... 310/90.5
2003/0025410 A1 * 2/2003 Sun ..... 310/90.5

FOREIGN PATENT DOCUMENTS

CN 2374674 4/2000
CN 2535586 2/2003
CN 2546670 4/2003
TW 535940 6/2003

* cited by examiner

*Primary Examiner*—Dan D Le
(74) *Attorney, Agent, or Firm*—Birch, Stewart, Kolasch & Birch, LLP

(57) ABSTRACT

A fan includes a frame, a stator, a rotor and a magnetic member. The frame comprises a base. The stator is connected to the frame. The rotor has a shaft. The magnetic member, corresponding to the shaft, is disposed on the base to attract the shaft. The magnetic member and the shaft are spaced apart with the base disposed therebetween. The magnetic member may be disposed outside or inside the frame or on the stator.

16 Claims, 5 Drawing Sheets

FAN

This Non-provisional application claims priority under 35 U.S.C. §119(a) on Patent Application No(s). 092127917 filed in Taiwan, Republic of China on Oct. 8, 2003, the entire contents of which are hereby incorporated by reference.

BACKGROUND

The present inventions relates to a fan and in particular to a fan with a magnetic member.

A conventional fan is shown in FIG. 1, including a rotor 1, a stator 2 and a frame 3. The rotor 1 connects the stator 2 by a C-ring 4, keeping the stasis of the rotor 1 and the stator 2.

After assembly, the center of the magnet belt 13 in the rotor 1 and the center of a coil 22 in the stator 2 are at the same height. Namely, the magnetic center A of the magnet belt 13 and the magnetic center B of the coil 22 are positioned in line. When the rotor 1 rotates, airflow produces an elevating force on the rotor 1, a shaft 15 of which then shifts up and down. Thus, the fan generates noise, and the C-ring 4 and other elements can be damaged by the vibration.

One conventional method to solve the problem mentioned is shown in FIG. 2, in which the magnetic center A of the magnet belt 13 is positioned higher than the magnetic center B of the coil 22. Namely, the center of the magnet belt 13 is higher than the center of the coil 22. When the electrical field surrounding the coil 22 rotates the rotor 1, magnetic attraction is generated on the magnet belt 13 of the rotor 1 and pulls the rotor 1 down, reducing elevating force on the rotor 1.

This method cannot, however, be used with fans having different speeds, high speeds, or reverse assembly. The attracting force is not strong enough to attract and secure the rotor 1, decreasing heat-dissipation efficiency. Further, some rotational force of the rotor 1 is converted to elevating force, decreasing speed.

SUMMARY

Therefore, an object of the present invention is to disclose a fan that solves the above mentioned problem.

The fan comprises a frame comprising a base, a stator, a rotor and a magnetic member. The stator is connected to the frame. The rotor has a shaft. The magnetic member, corresponding to the shaft, is disposed on the base to attract the shaft. The magnetic member and the shaft are spaced apart with the base disposed therebetween.

The fan also comprises a stator, a rotor and a magnetic member. The rotor has a shaft. The magnetic member attracting the shaft is disposed on the rotor and corresponding to the shaft without making contact therewith. The rotor encircles the stator, or is encircled by the stator.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the subsequent detailed description and the accompanying drawings, which are given by way of illustration only, and thus are not limitative of the present invention, and wherein.

DETAILED DESCRIPTION

First Embodiment

Figure 1:
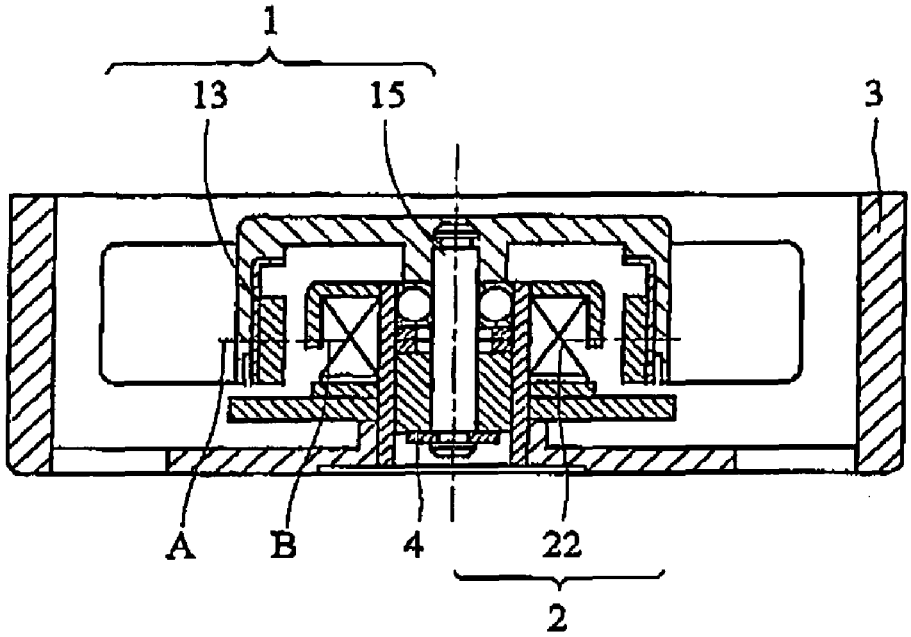
FIG. 1 ( PRIOR ART )
FIG. 1 is a schematic diagram of a conventional fan.
Figure 2:
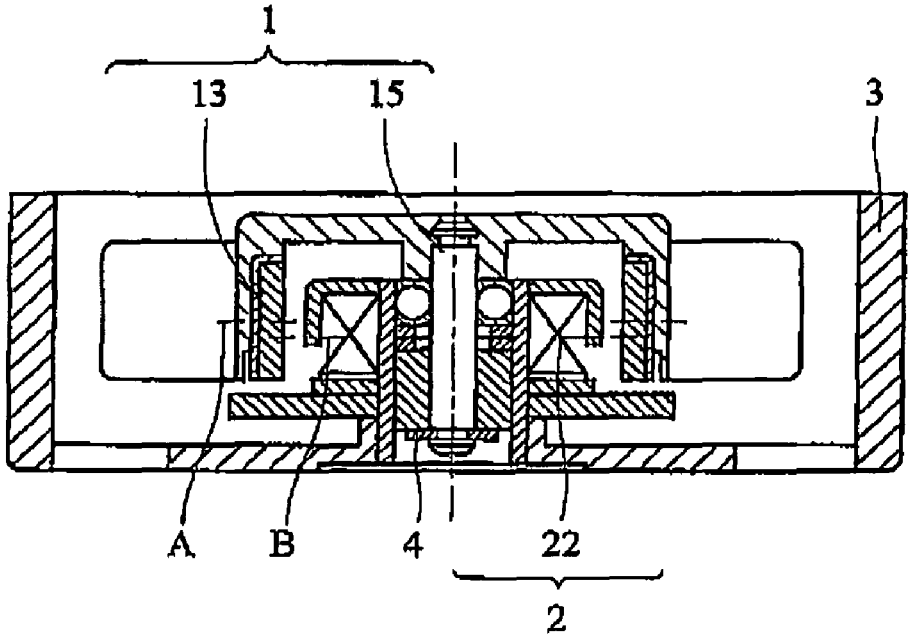
FIG. 2 ( PRIOR ART )
FIG. 2 is a schematic diagram of another conventional fan.
Figure 3A:
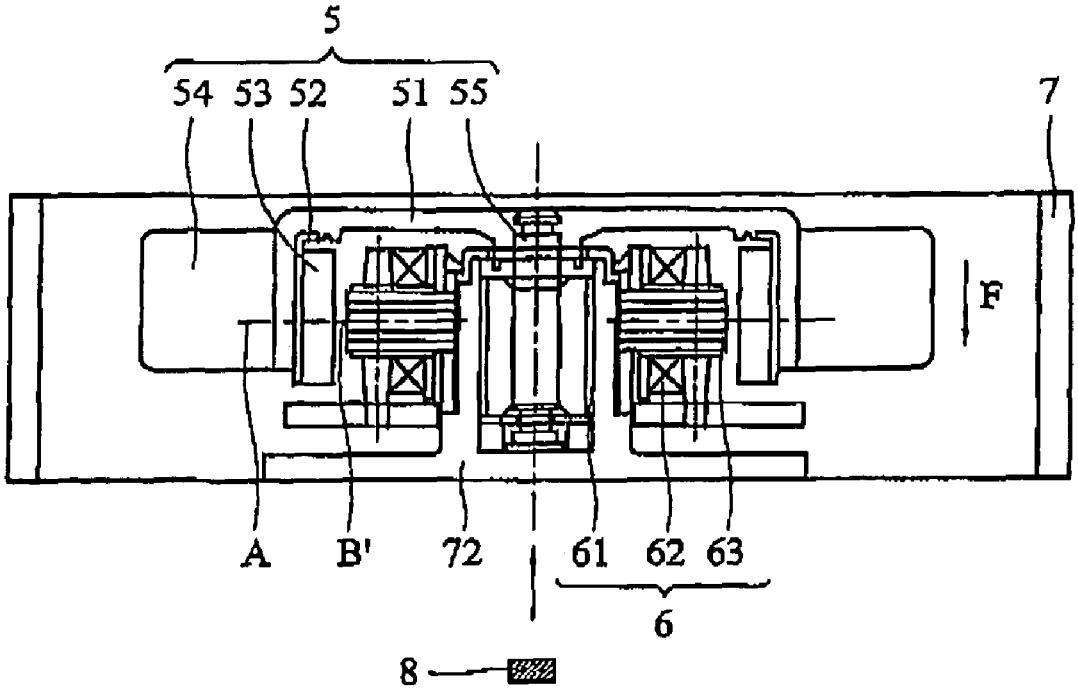
FIG. 3*a* is a schematic diagram of a fan of a first embodiment wherein a magnetic member is not attached to the fan yet.
Figure 3B:
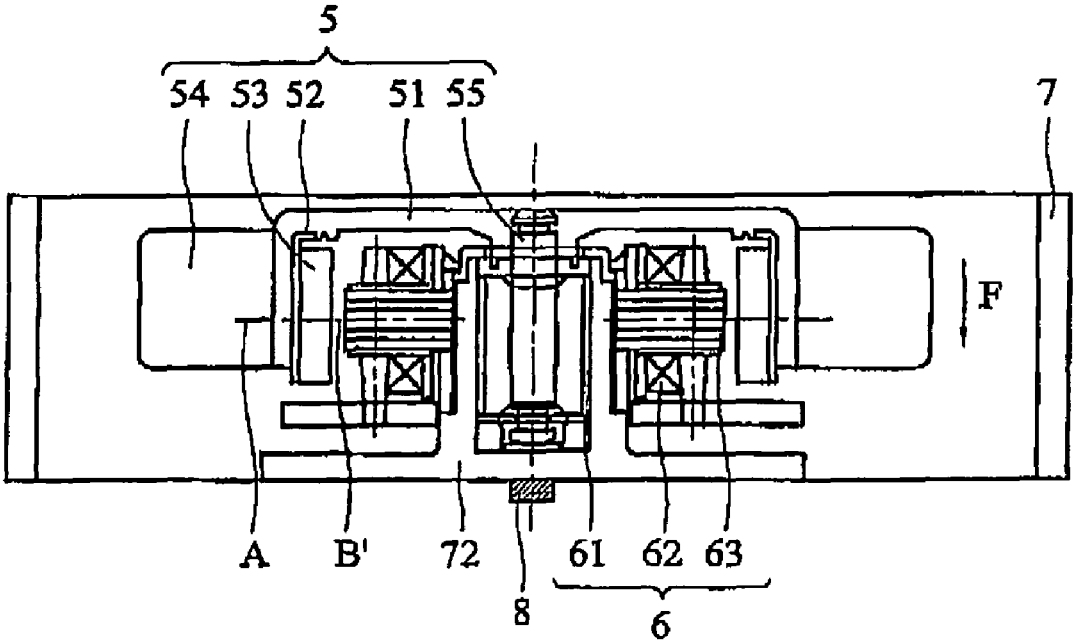
FIG. 3*b* is a schematic diagram of a fan of the first embodiment, with the magnetic member attached thereto.

FIGS. 3*a* and 3*b* show a fan of this first embodiment. The fan comprises a rotor 5, a stator 6, a frame 7 and a magnetic member 8.

The rotor 5 comprises a housing 51, a metal shield 52, a magnet belt 53, blades 54 and a shaft 55. The housing 51, metal shield 52 and the magnet belt 53 are annular. The metal shield 52 is disposed in the housing 51, and the magnet belt 53 in the metal shield 52. The blades 54 are disposed around the periphery of the housing 51, and the shaft 55 is disposed inside the housing 51. In the present invention, the shaft 55 of the rotor 5 can be permeable magnetic material, and the magnetic member 8 can be a magnet or magnetic material.

The stator 6 comprises a bearing 61, a coil 62 and a pole plate 63. The pole plate 63 can be a silicon steel sheet and the coil 62 is wound around pole plate 63. The coil 62 and the pole plate 63 are then connected to the bearing 61.

The bearing 61 engages the shaft 55 such that the rotor 5 engages the stator 6. Meanwhile, the magnet belt 53 surrounds the coil 62 and the pole plate 63. Finally, the stator 6 is connected to the frame 7 completing the fan.

The magnetic member 8 is attached to a bottom surface of the base 72 and corresponds to the shaft 55. The magnetic member 8 and the shaft 55 do not contact each other. In this embodiment, the magnetic member 8 provides an attracting force F on the shaft 55. When the stator 6 is electrified, a magnetic force is generated and reacts to the magnet belt 33 of the rotor 5 by the pole plate 63 so that the rotor 5 rotates. The shaft 55 of the rotor 5 is attracted by the magnetic member 8 such that the rotor 5 does not elevate and vibrate. Further, the magnetic member 8 may attach on the frame 7 or on the stator 6.

In FIGS. 3*a* and 3*b*, the magnetic center A of the magnet belt 53 and the magnetic center B' of the pole plate 63 are positioned inline. Due to the attracting force F of the magnetic member 8 attracts the shaft 55, the rotor 5 does not elevate, and the fan operates more stably. The present invention can be utilized in a fan with high speed or with reverse assembly, increasing operating stability thereof. Moreover, no force between the magnet belt 53 and the pole plate 63 is converted to attracting force, increasing the speed of the fan.

The size of the magnetic member 8 may vary with demand. The magnetic member 8 not only attracts rotor 5 but also enhances alignment of shaft 55 to decrease attrition on the bearing 61, increasing the life of the fan.

Second Embodiment

Figure 3C:
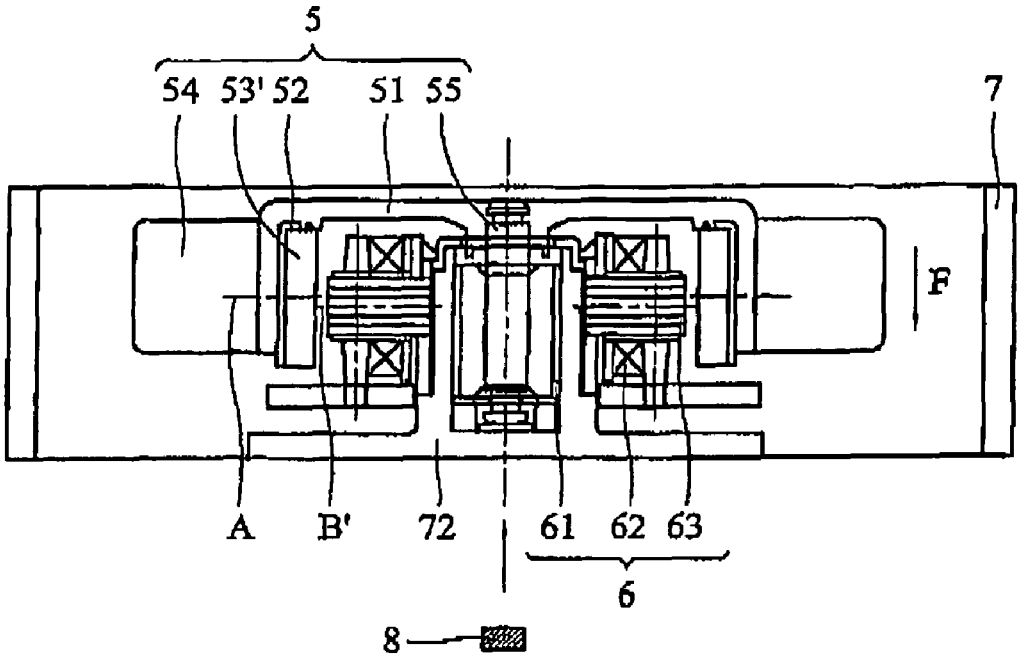
FIG. 3*c* is a schematic diagram of a fan of a second embodiment wherein a magnetic member is not attached to the fan yet.
Figure 3D:
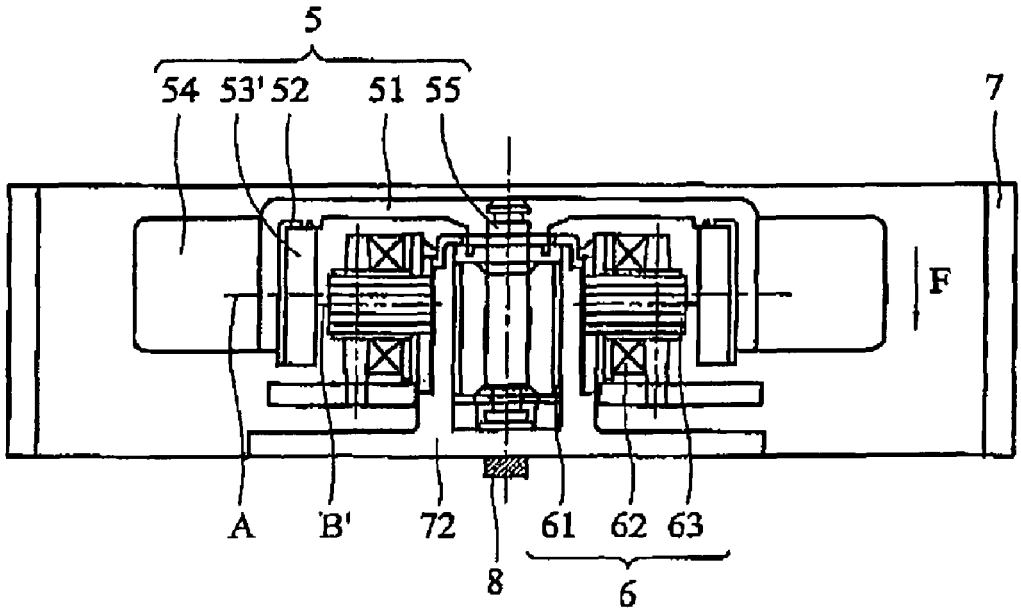
FIG. 3*d* is a schematic diagram of a fan of the second embodiment, with the magnetic member attached thereto.

FIGS. 3*c* and 3*d* show a fan of the second embodiment, from which elements common to the first embodiment are omitted. In this embodiment, the magnetic center A of the magnet belt 53' is higher than the magnetic center B' of the pole plate 63. When the electric field surrounding the coil 62 rotates the rotor 5, magnetic attraction is generated, attracting the magnet belt 53' and pulling the rotor 5 downward. The magnetic attraction and the attracting force F generated by the magnetic member 8 decreases elevating force on the rotor 5 to a minimum, stabilizing operation even for high speed or reverse assembly fans.

Third Embodiment

Figure 4A:
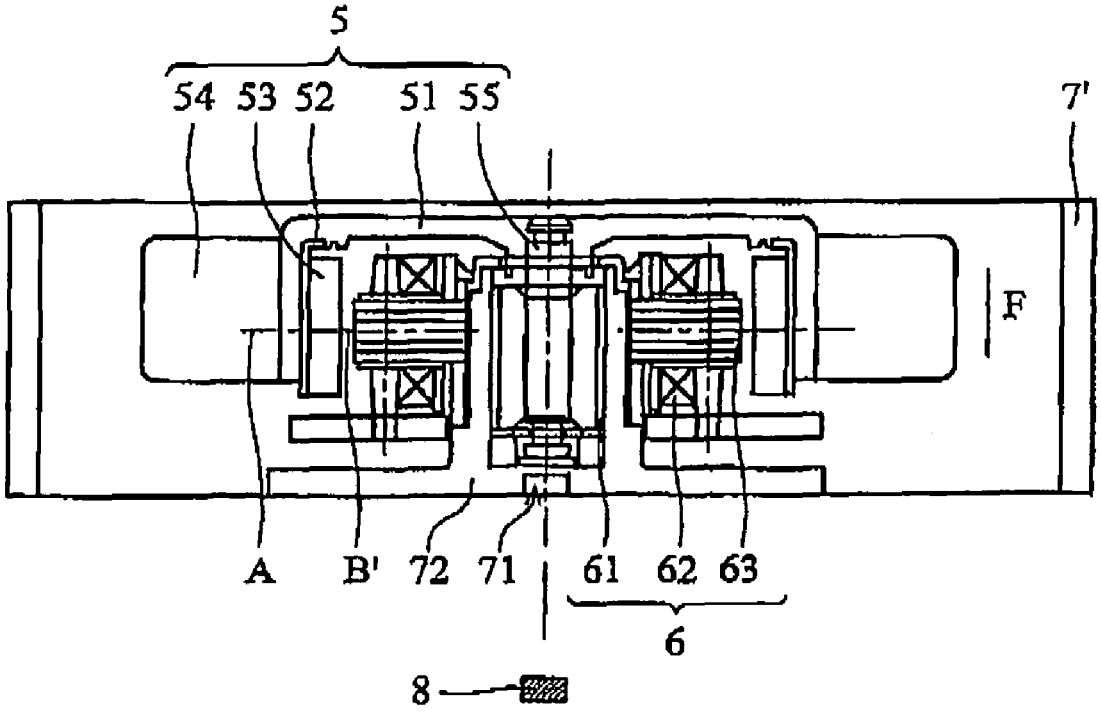
FIG. 4*a* is a schematic diagram of a fan of a third embodiment wherein a magnetic member is not attached to the fan yet.
Figure 4B:
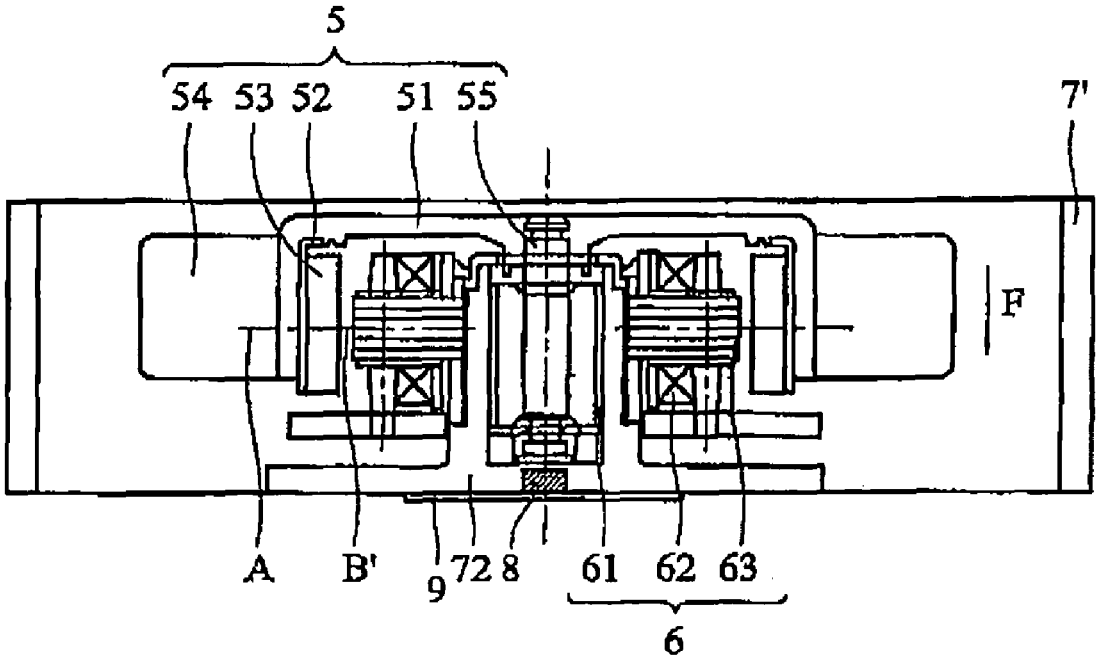
FIG. 4*b* is a schematic diagram of a fan of the first embodiment, with the magnetic member attached thereto.

FIGS. 4*a* and 4*b* show a fan of the third embodiment, from which elements common to the first embodiment are omitted. In this embodiment, the magnetic member 8 is disposed in the recess 71 on the frame 7 according to the shaft 55. The magnetic member 8 and the shaft 55 are spaced apart with the base 72 disposed therebetween and do not contact each other. The recess 71 mentioned may be formed on an inner surface or an outer surface of the frame 7 or on the stator 6.

In FIGS. 4*a* and 4*b*, the magnetic center A of the magnet belt 53 and the magnetic center B' of the pole plate 63 are positioned inline. Due to the attracting force F of the magnetic member 8 attracts the shaft 55, the rotor 5 does not elevate, and the fan operates more stably. The present invention can be utilized in a fan with high speeds or with reverse assembly, increasing operating stability thereof. Moreover, no force between the magnet belt 53 and the pole plate 63 is converted to attracting force, increasing the speed of the fan.

Furthermore, a protecting layer 9 is disposed on the frame 7' to protect the magnetic member 8. The protecting layer 9 may be a paper, metal, or plastic layer.

Fourth Embodiment

Figure 4C:
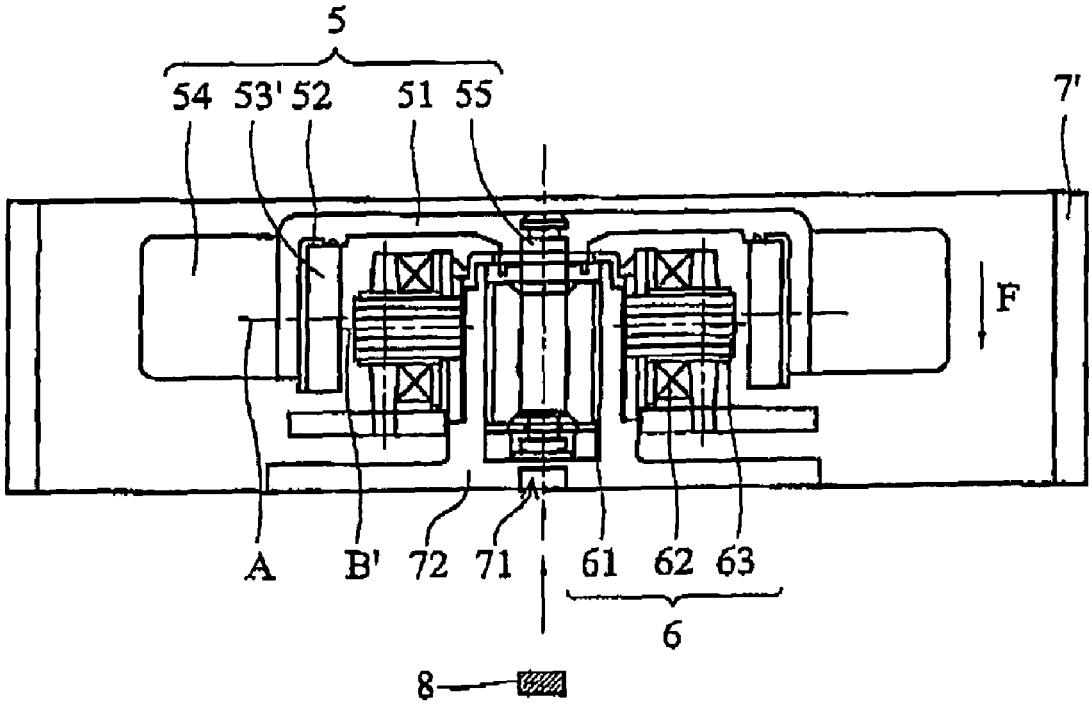
FIG. 4*c* is a schematic diagram of a fan of a fourth embodiment wherein the magnetic member is not attached to the fan yet.
Figure 4D:
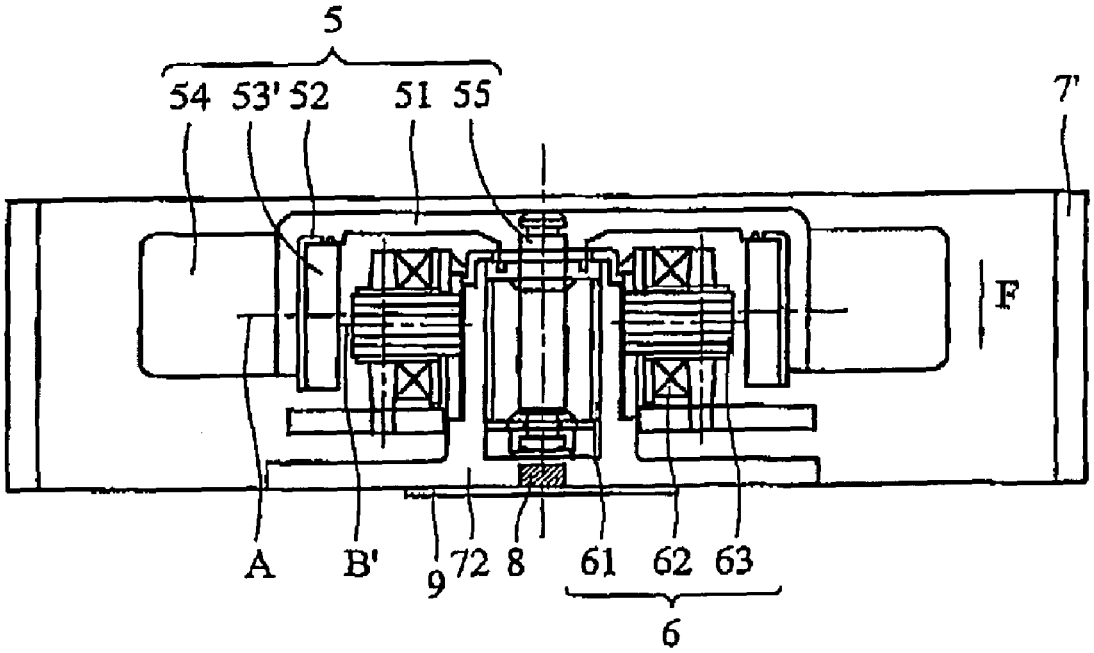
FIG. 4*d* is a schematic diagram of a fan of the fourth embodiment, with the magnetic member attached thereto.

FIGS. 4*c* and 4*d* show a fan of the fourth embodiment, form which elements common to the third embodiment are omitted. In this embodiment, the magnetic center A of the magnet belt 53' is higher than the magnetic center B' of the pole plate 63. When the electric field surrounding the coil 62 rotates the rotor 5, magnetic attraction is generated, attracting the magnet belt 53' and pulling the rotor 5 downward. The magnetic attraction and the attracting force F generated by the magnetic member 8 decreases the elevating force on the rotor 5 to a minimum, stabilizing operation even for high speed or reverse assembly fans.

Otherwise, the mentioned embodiments employ a rotor encircling a stator to describe the invention, but are not limited thereto. The invention may utilize in a fan that the stator encircles the rotor.

While the invention has been described by way of example and in terms of preferred embodiments, it is to be understood that the invention is not limited thereto. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A fan, comprising:

a frame having a base and a recess formed on an outer surface of the base;

a stator connected to the frame;

a rotor having a shaft and at least one blade thereon; and a magnetic member received in the recess of the base and located on a central axis of the shaft to attract the shaft, wherein the frame and the base are formed as a single piece, and the magnetic member and the shaft are separated by the base.

2. The fan as claimed in claim 1, wherein the magnetic member is disposed on the frame.

3. The fan as claimed in claim 1, wherein the magnetic member is attached to a bottom surface of the base.

4. The fan as claimed in claim 1, further comprising a protecting layer disposed on the frame to cover the magnetic member.

5. The fan as claimed in claim 4, wherein the protecting layer is constructed of materials selected from the group consisting of paper, metal, plastic and combinations thereof.

6. The fan as claimed in claim 1, wherein the rotor has a housing, a metal shield and a magnet belt, the metal shield being disposed in/on the housing and the magnet belt being disposed in/on the metal shield.

7. The fan as claimed in claim 6, wherein the stator has a coil and a pole plate, the coil being wound around the pole plate, and the magnet belt surrounding the coil and the pole plate.

8. The fan as claimed in claim 7, wherein the magnetic center of the magnet belt is higher than or level with the magnetic center of the pole plate.

9. The fan as claimed in claim 6, wherein the housing is annular and has at least one blade disposed thereon.

10. The fan as claimed in claim 1, wherein the rotor encircles the stator.

11. The fan as claimed in claim 1, wherein the stator encircles the rotor.

12. The fan as claimed in claim 1, wherein the magnetic member is a magnet.

13. The fan as claimed in claim 1, wherein the shaft is a permeable magnetic material.

14. The fan as claimed in claim 1, wherein the magnetic member is constructed of magnetic material.

15. A fan, comprising:

a base having a recess on an outer surface of the base;

a stator disposed on the base;

a rotor having a shaft and at least one blade thereon; and a magnetic member received in the recess of the base and located on a central axis of the shaft to attract the shaft.

16. The fan as claimed in claim 15, wherein the rotor encircles the stator, or is encircled by the stator.

* * * * *